US009271530B2

(12) United States Patent
Kobayashi

(10) Patent No.: US 9,271,530 B2
(45) Date of Patent: Mar. 1, 2016

(54) WEARABLE IMPLEMENT

(71) Applicant: Nichiyou Hatsumei Gallery Co., LTD, Shizuoka (JP)

(72) Inventor: Toyohiro Kobayashi, Shizuoka (JP)

(73) Assignee: Nichiyou Hatsumei Gallery Co., LTD, Shizuoka (JP)

( * ) Notice: Subject to any disclaimer, the term of this patent is extended or adjusted under 35 U.S.C. 154(b) by 147 days.

(21) Appl. No.: 14/316,784

(22) Filed: Jun. 26, 2014

(65) Prior Publication Data

US 2014/0318154 A1 Oct. 30, 2014

Related U.S. Application Data

(63) Continuation of application No. PCT/JP2012/084264, filed on Dec. 21, 2012.

(30) Foreign Application Priority Data

Jan. 10, 2012 (JP) ..... 2012-014630

(51) Int. Cl.
*F25B 21/02* (2006.01)
*A41D 13/005* (2006.01)
*F25D 7/00* (2006.01)

(52) U.S. Cl.
CPC ..... *A41D 13/0056* (2013.01); *F25B 21/02* (2013.01); *F25D 7/00* (2013.01); *F25B 2321/02* (2013.01)

(58) Field of Classification Search
CPC ..... A41D 13/0053; A41D 13/0056; A41D 20/005; A41D 2400/22
USPC ..... 62/259.3
See application file for complete search history.

(56) References Cited

U.S. PATENT DOCUMENTS

2006/0191063 A1* 8/2006 Elkins ..... A41D 13/0053 2/458
2008/0289077 A1* 11/2008 Enlund ..... A41D 13/0053 2/81

(Continued)

FOREIGN PATENT DOCUMENTS

JP H11-172510 A 6/1999
JP H11-217707 A 8/1999

(Continued)

OTHER PUBLICATIONS

International Search Report for PCT/JP2012/084264 dated Mar. 5, 2013.

*Primary Examiner* — Daniel Rohrhoff
(74) *Attorney, Agent, or Firm* — Yokoi & Co., U.S.A.; Toshiyuki Yokoi

(57) ABSTRACT

Water absorbing material provided in a planar shape over the substantially entire surface of a front side surface of cooling clothing is layered with an intermediate cloth having air permeability and a waterproof material or sheet, which is waterproof, to be sandwiched and wrapped therewith. By sewing or by sealing and joining the intermediate cloth and waterproof cloth or sheet, waterproof water dividers having length in the horizontal direction are provided at a suitable inclined angle of locations. Water that is inserted from a water inlet in the upper part of the cooling clothing by a PET bottle or the like flows toward the lower part of the cooling clothing between the surface of the water absorbing material and the waterproof cloth, meandering left and right continuously or in a stepwise shape, and making a puddles arise like terraces in prescribed locations here and there.

6 Claims, 10 Drawing Sheets

(56) References Cited

U.S. PATENT DOCUMENTS

| | | | | |
|---|---|---|---|---|
| 2010/0031428 | A1* | 2/2010 | Paull | A41D 13/0053 2/458 |
| 2010/0223943 | A1* | 9/2010 | Loukaides | A41D 13/0053 62/259.3 |
| 2010/0286755 | A1* | 11/2010 | Gallaher | A41D 13/0053 607/108 |
| 2011/0094012 | A1* | 4/2011 | Toth | A42B 3/121 2/171.2 |
| 2015/0150313 | A1* | 6/2015 | Huckins | A41D 13/0056 62/259.3 |
| 2015/0313294 | A1* | 11/2015 | Yue | A41D 13/0025 2/69 |

FOREIGN PATENT DOCUMENTS

| | | | |
|---|---|---|---|
| JP | 2001-040512 | A | 2/2001 |
| JP | 2002-242007 | A | 8/2002 |
| JP | 2009-127147 | A | 6/2009 |

* cited by examiner

WEARABLE IMPLEMENT

CROSS-REFERENCES TO RELATED APPLICATIONS

This Application claims the benefit of priority and is a Continuation application of the prior International Patent Application No. PCT/JP2012/084264, with an international filing date of Dec. 21, 2012, which designated the United States, and is related to the Japanese Patent Application No. 2012-014630, filed Jan. 10, 2012, the entire disclosures of all applications are expressly incorporated by reference in their entirety herein.

BACKGROUND OF THE INVENTION

1. Field of the Invention

This invention relates to cooling garment for cooling the body and thereby promote vaporization of the water that is the water retention in the water absorbing material. And, similar cooling cover such cool the head of the people, etc., about the wearable implement.

2. Description of Related Art

Measures the heat of the outdoors in the summer, as heat stroke measures, there is a cool vest, etc. that can be worn by dog animals and the human body.

Cooling garment that can be provided on the planar water-absorbing material for water retention of moisture in the clothes, and absorbs heat in the heat of vaporization by the evaporation of the water, to cool the body is well known.

For example, prior art documents, there is a JP 11-172510.

And immersing the entire surface water such as a container filled with water the water absorbing material of surface shape, and squeeze excess water. And I have put in the pocket of the chest or back pocket of fire-fighting clothing.

There is an example that describes the adoption of an arrangement for cooling the body and in a high temperature environment of the fire.

In addition, there is a description example of a cooling garment Vest that in JP 2001-40512, is provided with a fan at the upper end, flowing air by providing a mere air passage space between the inner fabric and outer fabric, air-cooling the human body.

And outdoor work under the hot weather of summer, incinerators around the fire work like high-temperature environment, I want to get sufficient cooling effect in the upper half of the body of the human body. To do so, in the water absorption of the surface material's built-in pre-sewing, etc., that you cover the entire upper body as much as possible of it is necessary to such clothes Vest.

And, to a cooling garment high cooling effect this, there is a problem such as (1) to (4) below.

(1);That in order to soak in water uniformly throughout the water absorption of the material, a large container filled with water is required.

(2); The operation to narrow twisting the clothes considerable force with both hands is necessary in order to eliminate squeeze any excess water .

(3); Furthermore , cooling effect time under the hot weather and the like end , it reaches the dry state , again , take off their clothes , and infiltrate water retention in the water providing a large container again , filled with the water , to be worn again there is a hassle that must behave .

(4); There is a cooling garment incorporating a water-absorbing material. You want to include in this cooling garment electric blower for sending air to air passage between the inner fabric and the middle cloth. In this case, Air passage also may give rise to large wind pressure loss places closed is twisted, the electric blower is weak to water, it is difficult to incorporate.

There is a problem to be solved that.

BRIEF SUMMARY OF THE INVENTION

In an aspect of the present invention, a wearable implement has a water absorbing material having a planar shape; and a waterproof breathable sheet or cloth having both functions of waterproof and breathable, wherein the water absorbing material is wrapped by the waterproof breathable sheet or cloth at one side or both sides, a gap is formed between the water absorbing material and the waterproof breathable sheet or cloth, a water inlet is provided so that water is filled in the gap from an outside, a waterway is configured by a sewing or an adhesion joint processing of the waterproof breathable sheet or cloth, which wraps the water absorbin material, so that the water flows vertically and horizontally on an entire surface of the water absorbing material, and the water filled from the water inlet is dispersed over the entire surface of the water absorbing material and penetrated into the water absorbing material so as to obtain a cooling effect of heat of vaporization.

The described cooling garment of the present invention to solve the foregoing problems. The superposed each other by wrapping sandwiched between the inner fabric and the intermediate cloth water absorbent material capable of absorbing water as an example, provided in a planar shape the size of substantially the entire outer surface of the cooling garment, a water several times its own weight and so as to be integrated, it is joined by waterproof seal junction or sewn places partially.

Then, over the entire surface of the water absorbing material of the surface of the joint is provided with a plurality of dispersion.

In the state where the worn on the upper body of a human, opening into the water provided in the upper portion of (injection port), cooling garment of the present invention can be inserted by a water bottle or the like.

Then, over substantially the entire surface of the water absorbing material, from the top, towards the lower direction stepwise, while meandering from side to side, it is possible to form a water channel where water flows.

Thus, it is possible to supply water by dispersing the water absorbing entire surface.

In another aspect of the present invention, a portion configured by the sewing or the adhesion joint processing has a width like a character of V in a horizontal direction,

- a partition is provided to form a puddle and configure the waterway in a stepped shape downwardly from a top,
- moisture is replenished widely to an upper side of left and right of the entire surface by the water of the puddle and capillary action of the water absorbing material so as to obtain the cooling effect of heat of vaporization.

To provide a partition of the water to have a recess and the tilt angle appropriate to the water channel, having a length in the horizontal direction.

And, of the many puddles of water storage for the temporary is provided on the entire surface of the upper, lower, left and right this cooling garment.

Then, the capillary action of the fabric and the water absorbing material itself, over time, the water is dispersed in a wide area of the upper portion of the puddle.

Then, for example, the water absorbing material surface having size corresponding to nearly the entire surface of the upper body front surface of a human, over the entire vertical and horizontal, to provide a partition of the plurality of water with a moderate distance. Thus, over the entire surface of the water absorbing material, and it can distribute the water, it is possible to penetrate water absorption water retention water almost equally.

By means of the present invention, I resolve to (1), (2) and (3) of the problems to be solved as described above this.

In another aspect of the present invention, when a plurality of partitions are provided, an interval between the partition is within a range that the moisurure can be raised by the capillary action of the water absorbing material.

The water absorption exceeds the maximum amount of water absorption by the material whole entire surface is too much water to be inserted from the plastic bottles. Then, it is beyond the folded portion of the sheet or tarpaulins, water would overflowing the cooling garment is considered. This solution due to the fact that in order to prevent this, the provision of the arrival detection part of the water in the lower cooling garment can also be presented.

In another aspect of the present invention, a sensing location, which is a hollow of the water absorption material, is provided at a lower end of the water absorption material so as to detect that the water inserted from the water inlet reaches the lower end by a human finger.

In another aspect of the present invention, an inlet is provided for blowing air from a small fan, the waterway configured in the stepped shape is also used as an air passage, the water inlet is also used as an outlet of the air, and the vaporization is promoted at the surface of the water absorbing material by blowing the air from the small fan after the water is penetrated into the water absorbing material.

To provide a small fan by the motor drive of the battery and the air intake at the bottom of the waterway of the foregoing description of the cooling garment of the present invention.

After the insertion of water, the water in the puddle by the capillary phenomenon has been absorbed by the water absorption material, due to the small fan is blown.

To provide a means, such as changing the air passage of the waterway before description, and, to change the exhaust port opening into the water at the top of the cooling garment.

As a result, while continuing to wear the cooling garment, and was greatly promoted the vaporization of the water absorbing surface, further, since it is increasing the cooling effect, it also solves the problem (4).

In another aspect of the present invention, a cooling source of a refrigerant, an ice or a Peltier effect thermoelectric cooling element is provided so as to be in contact with the water filled or the water of the puddle.

According to the cooling garment of the present invention, there is an effect of the functional, such as the following.

1; In order to penetrate water retention of water on substantially the entire surface of the water absorbing material of large surface form the cooling garment, a large container filled with water for immersion in water the clothes for each is required.

In addition, in order to remove excess moisture, strong force to squeeze the clothes in considerable force with both hands is required.

However, in the present invention, while wearing the cooling garment, it can be easily injection of water in plastic bottles, and the like from the water inlet at the top of the cooling garment.

Further, it is possible to disperse the water over substantially the entire water absorbing material of the foregoing description, and infiltrating water retention and water evenly. Large container of said also, the power to squeeze even twisting without the need, there is an effect of less powerful men and women of all ages can use with ease.

2; Furthermore, the cooling effect of time under the scorching sun, etc. have passed, vaporization of the moisture of the water-absorbing material is the end, if it is even in the dry state, there is no need to take off their clothes again.

Further, there is no need to provide a large container filled with water.

Easily, it is possible to replenish the water in plastic bottles, and the like from the opening to put in the water.

Then, it is possible to reproduce a cooling effect over the entire cooling garment by dispersing water over substantially the entire surface of the water absorbing again infiltrate water retention water evenly.

The use, in the work, this can be expected to be a breakthrough effect during use, while moving in the sport, it is possible to replenish the water easily even while running, can last a long time in succession cooling effect.

3; Also, at this time, it is too put the water from the inlet to put in water, the water overflows from the folded portion of the sheet or tarpaulin cooling garment bottom edge. When wetted with water or the like trousers, it becomes uncomfortable results. Therefore, in a part of the folded portion for example I provided the part has been removed partially cut the water absorbing material that is very thick.

I reach the detection part of the water. The replenish water in plastic bottles, and the like from the inlet into the water in the upper right hand Thus, fingertips of the left hand, it is possible to detect that you feel the arrival detection portion of the water provided at the lower end, the water reaches the lower end.

Therefore, I can stop the supply of water. Then, there is an effect that it is possible to prevent the water overflow.

4; In addition, there is a waterway of water partition by joining by sewing or the like forming a puddle of the foregoing description.

When the wind blowing in reverse, since there is provided a small Juan previous description, the intake air by the air duct to the flow of water, the partition has a tilt angle of the blast forward of the wind. Thus, ventilation resistance is a small air passage. That is, after the flowing water to the water channel, water puddles absorbed in the water absorbing material in capillary action, and blowing air from the bottom to the top. Therefore, the waterway is the air passage in order to facilitate the vaporization evenly over the entire surface of the water absorbing material. Therefore, there is no need to construct separate and to construct the air path present invention, a large effect can be achieved at low cost.

5; FIG. 12, 13, by 14, describes an example of a cooling cover to cool the head.

Again, I use the capillary action of the water-absorbing material that covers the surface like the head. to 5~10 cm interval of about vertical height limit of moisture over go, is provided with a water partition portion extending horizontally, to configure the water reservoir.

Therefore, the moisture to penetrate into the upward direction of the water reservoir in the capillary action of the water-absorbing material.

Then, the uniform or the like vertically and horizontally the entire surface of the water absorbing material, since it is made to absorb moisture in the reservoir until the water disappears, it is possible to obtain the cooling effect of the heat of vaporization for a long time.

In this way, the cooling shroud and cooling garment of the present invention is intended to be usable to people, animals also.

Therefore, these can be referred to as a cooling wearable implement collectively.

6; As can be shown by the example of the cooling wearable implement of description in FIG. 15, 16, 17 of the present invention, or the water near the water reservoir is provided with a cold source of the refrigerant such as Peltier effect devices in contact therewith.

The position change of an operation state of the wearable implement, to mix with the cold water in contact with the cooling source and the water is allowed to flow back to the water, warmed. Therefore, it is possible to infiltrate the water absorbing cooling water uniformly throughout to obtain the cooling effect of evaporation heat further.

DETAILED DESCRIPTION OF THE INVENTION

The following describes the embodiments of the present invention with reference to the drawings.

Figure 1:
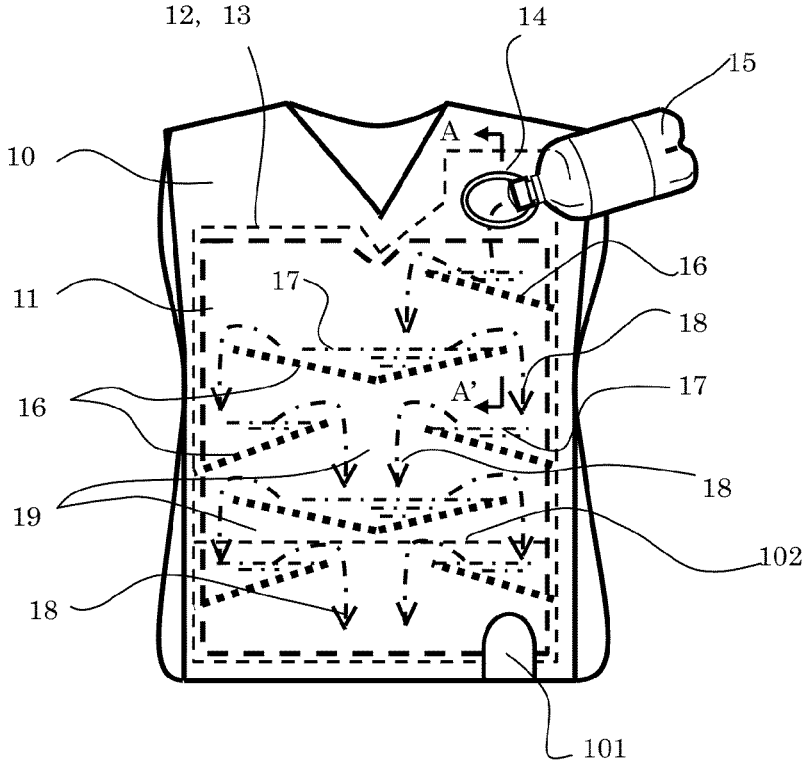
FIG. 1 is a schematic front view of the front side of the cooling garment according to an exemplary embodiment of the present invention.
Figure 2:
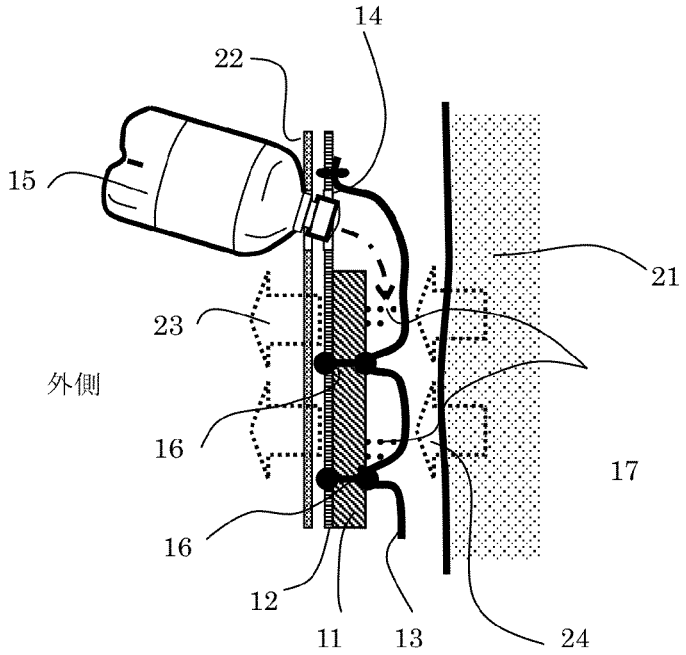
FIG. 2 is a schematic sectional view of A-A shown in FIG. 1 of the present invention cooling garment.

FIG. 1 shows schematic front view of the front side of the cooling garment according to an exemplary embodiment of the present invention. FIG. 2 is a schematic sectional view of A-A' shown in FIG. 1 of the present invention cooling garment.

Cooling garment 10 of the present embodiment is worn as best upper body of a human body. It is obtained by cooling the upper body, is used to heat stroke measures and heat measures.

Water absorbing material 11 over the entire surface substantially front side of the cooling garment 10 can be water-absorbing water retention and water several times its own weight is provided on the planar.

Water absorption material of the planar is or wrap the front and back both sides are sandwiched between the sheet or tarpaulin 13 cloth and intermediate pad 12.

Are configured to square periphery is sealed by thermal bonding or sewing them.

Further, breaking through the outer cloth 22 at the upper portion of the cooling garment 10 is provided with a water inlet port 14 into the opening in the water of the intermediate pad 12.

At this time, between the sheets or tarpaulin 13 planar, I provide a slight gap as well as the water- absorbing material 11 of the planar.

Therefore, as shown FIG. 1, FIG. 2, bottle 15 is inserted the water into there from the inlet of the water. It is possible to hydrate the water absorbing material 11 of the planar one.

The following is one of the object of the present invention.

Over almost the entire surface of the water absorbing material 11 wide planar, water that has been injected, it flows through the lower direction from the top.

And, and that the water is dispersed over the entire surface, including to the end of the left and right of the water absorbing material 11 and has been supplied uniformly, in the same manner as the water absorbing water retention.

Therefore, across the water absorbing material 11 of the surface shape, and for sealing of gluing by chemical adhesive or high-frequency thermal bonding or stitching process at a plurality of locations.

Connected to places linear sheet or tarpaulin 13 and the intermediate pad 12 Thus, it is bonded, to form the partition 16 in the water having a length in the horizontal direction. The partition 16 of the water has a moderate inclination angle, as shown in FIG. 1 with respect to the horizontal.

Cause a puddle for holding water 17, like the so-called rice terraces, at the position of the partition 16 of the water, do both of drainage downward 18 and holding water flowing from the top, the water channel 19 of the continuous stepwise can be configured.

As described before, this water absorbing material 11 is of a planar wide enough to span the upper body of the people, almost the entire surface.

The As described in problem to be solved by the present invention, as long soak cooling garment per the present water absorbing whole in a large container filled with water, to disperse uniformly substantially the entire large surface water-absorbing material is caused to water retention and water.

However, it is not so, and, only having to insert the water inlet port 14 into the water at the upper end of the cooling garment, people while wearing, the lower end from the top over the entire surface of the water absorbing material 11 of this planar direction, and it is distributed to every corner of the entire left of the water absorbing material 11, the extreme right, including the left and right, it is necessary to supply the water uniformly.

To do this, as shown in FIG. 1 the partition 16 of the water with said moderate inclination angle, the front such a cooling garment 10, the entire surface of the water absorbing material 11 is provided by widely dispersed plurality.

Needs to be configured to produce a water channel 19 of consecutive stepped, the water puddle 17 multiple of the entire water absorbing material 11.

This, and water absorption material 11, intermediate pad 12 suck up the puddle 17 for holding water by capillary action.

Then, it is possible to replenish moisture wide including a surface vicinity of the water absorbing material 11 in the upward direction water partition 16, thereby absorbing water retention.

Since this phenomenon occur with multiple dispersed to upper, lower, left and right end in the water absorbing entire surface, and can be every corner to infiltrate water absorption water retention of water on the entire surface of the water absorbing material 11 with the passage of time The capillary action of this case, for example, the balance in the own weight of water and the surface tension in the fiber gap of the water-absorbing material, the amount of moisture transport height and the rise of the water is determined is known.

In order to state the best cooling effect of the cooling garment 10 of the present invention, experiments were carried out for the selection of the water absorbing material 11.

For example, as one case. a water absorbing material 11 comprises a polymer composed mainly of sodium polyacrylate, and direct spinning.

It is constructed in weight 200 g/m$^2$, 2 mm thick, of about 2800 g/m$^2$ water absorption.

Increased penetration of moisture by capillary action after 10 minutes,

It spread a wide surface of approximately 5 cm in height above the water surface direction puddle 17 made by partition 16 of water.

I penetrated into 8 cm height after 30 minutes thereafter.

Then, substantially the same even 2-5 hours after, saturated with 10 cm to high, as balanced, limit has been reached.

Water absorbing material of the present invention is not limited to the direct spinning fibers containing a polymer composed mainly of sodium polyacrylate of the course.

For example, it may be a cloth towel that has been subjected to a hair implant material widely used in the home, the thick cotton.

There is an effect of low production cost in this case.

Further, on the other hand, it is possible that the water absorption amount is large, the height of the water rise by capillarity use a higher water absorbing material, to increase the vertical spacing of the partition 16 in the water. It is possible to uniformly spread the water to cooling garment entire surface by a partition 16 of water in the smaller number. In this case, there is an advantage to be able to make better design of cooling garment.

Heat, the cooling of the upper body by the heat of vaporization, I want to enough water absorption water retention over the entire surface of the water absorbing material 11 with into 30 minutes nearly as heat stroke measures.

If you have a 40 cm about height required above and below the water absorbing planar incorporated in the cooling garment 10 of the present invention is provided with a water storage pudlle 17 increased allocates left it at five stages around several vertically.

It is possible to solve the problem of the present invention in the description before you configure the waterways of continuous stepwise as in FIG. 1.

Water absorbing material 11 wide planar, from the water inlet 14, when you insert the start of the water, then, dispersing the water full top and bottom of the water absorbing material 11, left and right, until every corner almost, the water absorption evenly after 30 minutes about it is possible to cause water retention.

It was found that at this time, just most preferable to set the tilt angle and the horizontal length width of the partition 16 in the water as is sucked up by capillary action to the water absorbing material 11 around the water in the water puddle 17.

At this time, as the water absorbing material 11, and containing the polymer, particularly when employing the fibers were direct spinning, its containing polymer particles absorb water, the volume expansion of itself, compressing the gap of the direct spinning fiber, the water absorbing material 11 is an aggregate has been found to be difficult Mora water in the outer direction, the intermediate fabric, it becomes waterproof wall state.

This would be imaginable from the fact that the bag enclosing a large amount of the polymer particles has been used as sandbags flood disaster is well known.

Without leaking to the outside through the intermediate pad 12 is consequence, the water collected in the water puddle 17, all distributed by capillary action upward to the right and left near the water surface of the puddle 17 of the water absorbing material 11, and is permeated water absorbing water retention. Very good condition.

Further, by lapse of time thereafter, the vent and the outer, vaporized evaporation is promoted, the surface of the intermediate pad 12 side of the water absorbing material 11 which is water retention sufficiently can be obtained for a long time a cooling effect by it. I have found that good condition very still.

However, the water channel 19 is complex and stepped in, because it is not visible from the outside, with, in some cases too put a large amount of water inlet port 14 into the water.

You can become an extra water that can not be in the water absorption of water absorbing material inside, there is a case in which the folded portion 102 of the sheet or tarpaulin cooling garment until it reaches the lower end.

And configured to the shield water side 103, but when water or overflows from the upper end of the folded portion 102 occurs. As a means for solving this problem, to provide the ultimate detection portion 101 of the water in the cooling garment bottom edge. Only part of reaching detection portion 101 of the water, except off the water absorbing material that is very thick, which is provided with a cut portion 31 of the water-absorbing material. Front sheet or tarpaulin 13 that part, as reaching the detection portion 101 of water, and make up so that water accumulates the space only by the folded surface.

As a result, the water from the water inlet port 14 to flow from the top of the water absorbing material 11 in stages, I could places puddle.

Figure 3:
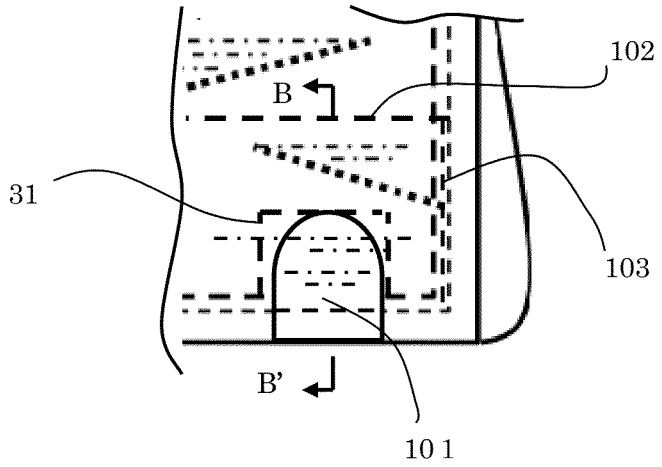
FIG. 3 is a diagram showing surrounding area of the water reaching detection portion of the present invention cooling garment lower position.

And, when it reaches the lower end, and if put in the cross-sectional direction in the index finger 42 and thumb 41 the arrival detection portion 101 of the water, for the touch of the finger, and, easily, reaching the degree of water can be clearly determined. FIG. 3 is a diagram showing a reaching detection portion near the water present invention lower cooling garment.

Figure 4A:
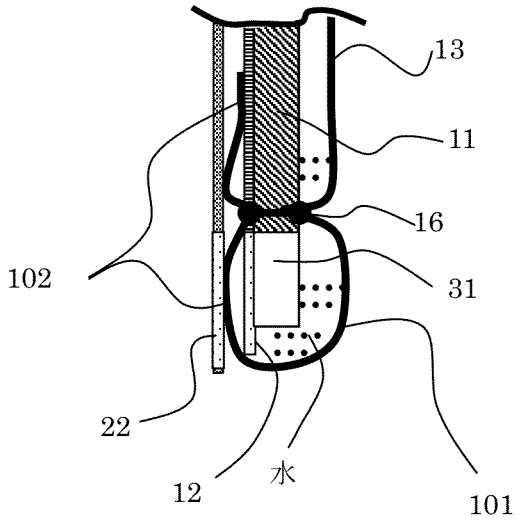
FIGS. 4A and 4B are a diagram showing a B-B' cross section shown in FIG. 3.
Figure 4B:
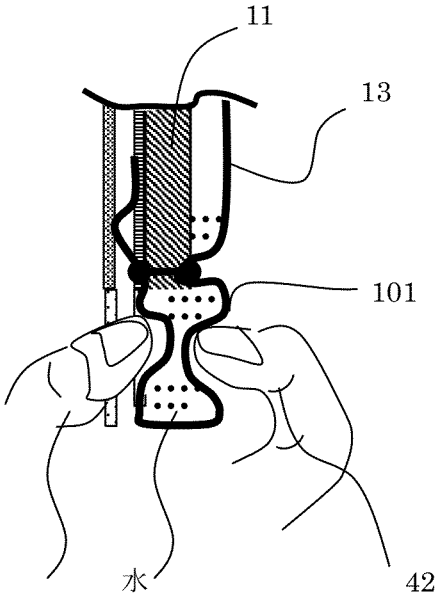

FIGS. 4A and 4B are diagrams showing a B-B' cross section shown in FIG. 3.

And shows a state prior to the touch sensing with a FIG. 4A.

And shows that FIG. 4B and feel with your thumb and index finger, and have reached the detection of water.

In FIG. 2, the middle intermediate pad 12 cloth that breathes, through the outer cloth 22 of cosmetic purposes good breathability, moisture of water absorbing material, shows how to take the heat vaporizes the outside 23 as well.

The thermally conductive heat 24 mainly by water absorbing material 11, sheet or waterproof tarpaulin 13 cloth is cool body side 21.

In this case, but could not get past drainage to body side 21, due to moisture evaporation vaporization is not come, and when worn underwear, etc. to side, the underwear is not wet.

Therefore, the amount of perspiration from the body is relatively small, I is suitable for construction work, such as civil engineering work in the outdoors.

Figure 11:
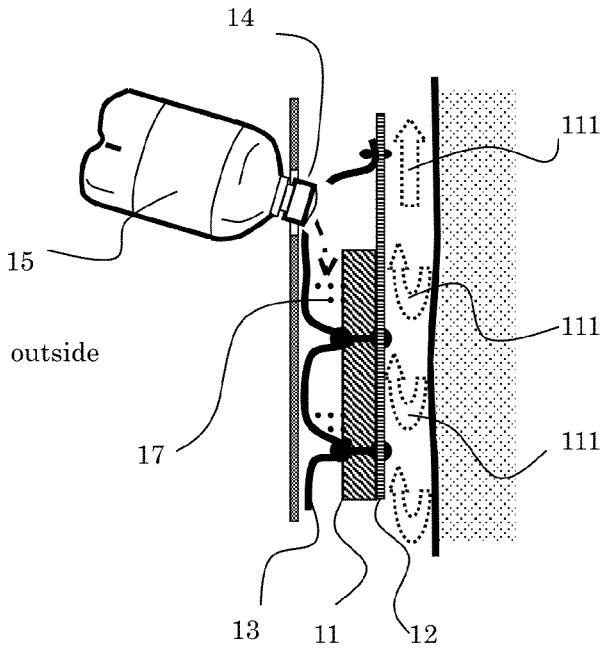
FIG. 11 is a diagram showing an example of disposed outside the sheet or tarpaulin.

In contrast, FIG. 11 is a diagram showing an example of disposed outside the sheet or tarpaulin.

In this case, the vaporization of the moisture of the water absorbing material 11 is performed, for example, in the gap between the body side 21 and an intermediate pad 12 which kept the air permeability.

111 shows the flow of the air stream of a state to take the heat from the body in the heat of vaporization. Depending on the sweat and the like material performance of intermediate pad 12, but the body is cooled in the heat of vaporization, but this case is also exposed to moisture by evaporation vaporization.

However, for example, so do not mind so much if you are also, do a lot of sweating and have fun with intense various sports of operation to sweating aggressively, without wearing underwear separately, this is, direct the cooling garment it is possible to wear the body and comfortable to use. Thus, examples of the arrangement shown in FIG. 11 is also effective as an embodiment of the present invention.

At this time, the sheet or tarpaulin 13 also intermediate pad 12 can also configure the cloth having a function that combines the breathable and waterproof, the so-called cloth of waterproof breathable.

then whether in the FIG. 2 or FIG. 11 case also, it is possible to obtain cooling by heat of vaporization without get wet the body side 21 by water moisture.

Figure 5:
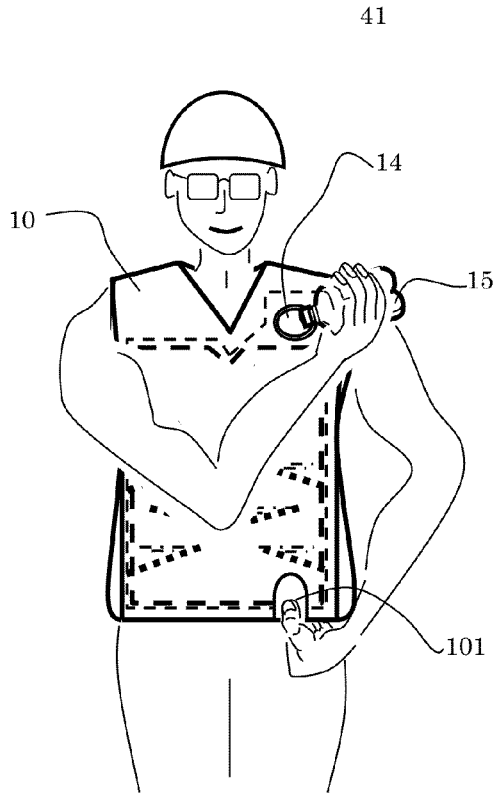
FIG. 5 is a diagram showing a usage state in which the water is inserted to cooling garment of the present invention.

FIG. 5 is a diagram showing a use state wear cooling garment of the present invention, are inserted water.

For example, in the left hand, and feel with your fingers reaching water detection portion 101 of the cooling garment 10 lower end of the front, the wearer, have confirmed the degree to which the water reaches to the bottom.

And I shows the use state that is inserted into the water inlet port 14 to put in the water at the top of the cooling garment 10 from plastic bottle 15 with the right hand.

I did experiment a prototype of the present invention.

In use, such as the FIG. 5, the time to reach the water reaches the detection unit amount of water to be inserted from the bottle, the upper portion of the cooling garment, as it is indicated by FIGS. 4A and 4B, it is possible to detect the amount reaches to the lower end of the water to feel the degree of swelling of the detection portion 101.

The three conditions, I can recognize the wearer himself learned empirically several times.

It has been found that this, adjust the water retention capacity of water absorption to water absorbing material 11 as a result, it is possible to adjust the degree of cooling by evaporation heat generation rate by it.

As a result, it is possible and the presence or absence of the surrounding environment of heat sources such as incinerators, be tailored to the activity of the wearer's temperature at the time of the wearing of the cooling garment of the present invention, around. Innovative effects can be used to be more comfortable is added.

Figure 6:
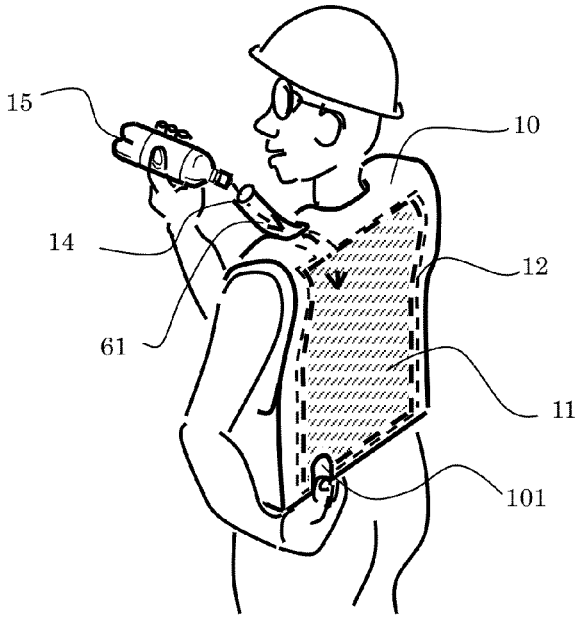
FIG. 6 shows that it has provided to a rear (the back surface) functions too of cooling garment of the present invention.

FIG. 6 shows that it has provided to (the back surface) and a rear functions of cooling garment of the present invention.

Wearer, for example, put from eater inlet port 14 to put in water bottled water with the right hand.

Providing a long pipe 61 from the over-the-shoulder of the cooling garment 10, I have configured to be capable of absorbing water water retention of water to the water-absorbing material 11 of the surface of the cooling garment shown in FIGS. 1 and 2 of the rear (back surface).

By providing the water reaches the detection portion 101 to the surface after this, it is possible to adjust the insertion amount of the water from above while detecting the arrival of water to the lower left hand as described above.

Figure 7:
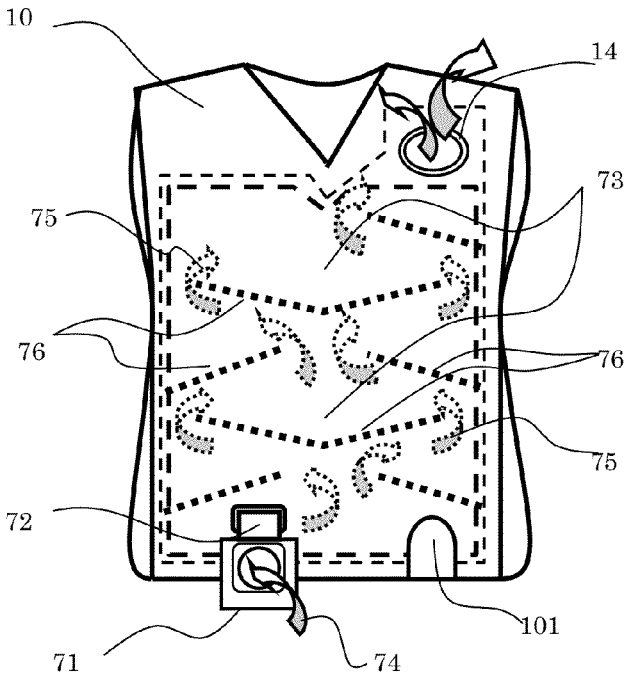
FIG. 7, an electric battery-powered, such as the air intake by the air insertion duct at the lower end of the cooling garment of the present invention, and it is a diagram showing an example in which the small fan.

FIG. 7 is a diagram showing an example in which a small electric anxiety driven by a battery and the air intake of the air duct inserted into the lower end of the cooling garment of the present invention.

Puddle 17 inside the cooling garment 10 described with reference to FIGS. 1 and 2 of the foregoing description.

Be composed water channel 19 by a partition 16 of water each having a moderate inclination angle.

And a cavity after the water has been inserted, is absorbed into the surface shape by capillary action of the water absorbing material 11.

For the air blown from the air intake port 72 by the air duct insertion and small electric fan 71 provided at the lower end, the inclination angle can be constructed the air passage 73 wind pressure loss in the favorable wind direction is small.

Intake air 74 flowing from the lower end of the cooling garment, the cavity air passage 73 of the gap of the water absorbing material 11 and sheet or tarpaulin 13 by driving the small electric fan 71.

I greatly encourage the vaporization of surface water absorbing material 11 over almost the entire surface of the front cooling garment 10.

While applying increasing the cooling effect by the evaporation heat, the air is exhausted from the port 14 into the water.

In cooling garment 10 of the present invention, when it is fitted with a small electric fan 71 at its lower end, the port 14 to put in water will be air exhaust port as this.

Water channel 19 will air passages 73 wind flows 75.

The partition 16 of the water becomes the partition 76 for the wind pressure loss is small, and forming the air passage in a stepwise manner over the entire surface of the water absorbing material.

It is possible to bring that can be used to serve as, respectively, a good utility cost. 75 in the figure shows the flow of wind through the air passage 73.

Thus, the wearer, comfort by the cooling effect is a large difference in the case you promote vaporized by small electric fan 71, in the case without it.

It has become possible to wear even in the poor thermal environment of high temperature work site.

Figure 8:
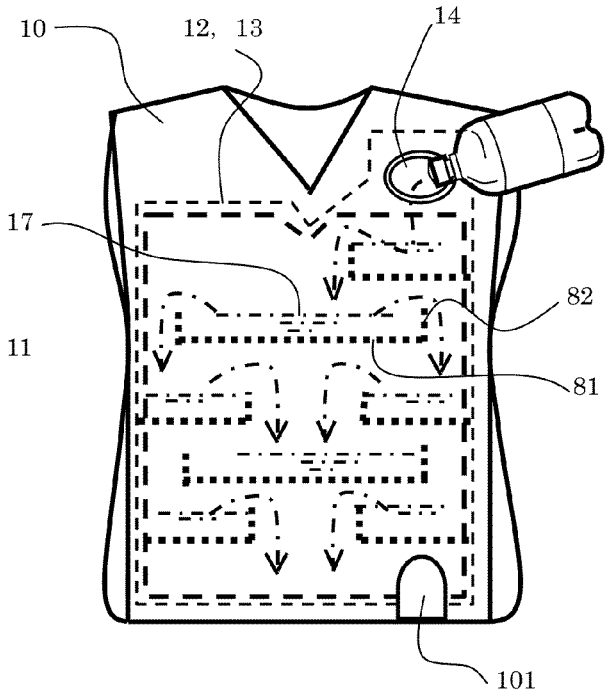
FIG. 8 shows that it is configured as a partition dam water cooling garment of the present invention.

FIG. 8 shows that it is configured as a partition dam water cooling garment.

Was described in the previous description FIG. 1, puddle 17 having a suitable inclination angle.

I illustrates a method for the same action as the partition 16 of the water for this purpose.

As shown in FIG. 8 is provided with a horizontal water partition 81 which is bonded or sewn, sheets or tarpaulins 13 and the intermediate pad 12 to a plurality of horizontally. Then, like the function with an appropriate height in the horizontal direction, I provide a vertical water partition 82 which is bonded or sewn as well.

The same effect can be obtained the present invention can be configured as a dam to perform water discharge by overflow and water.

Figure 9:
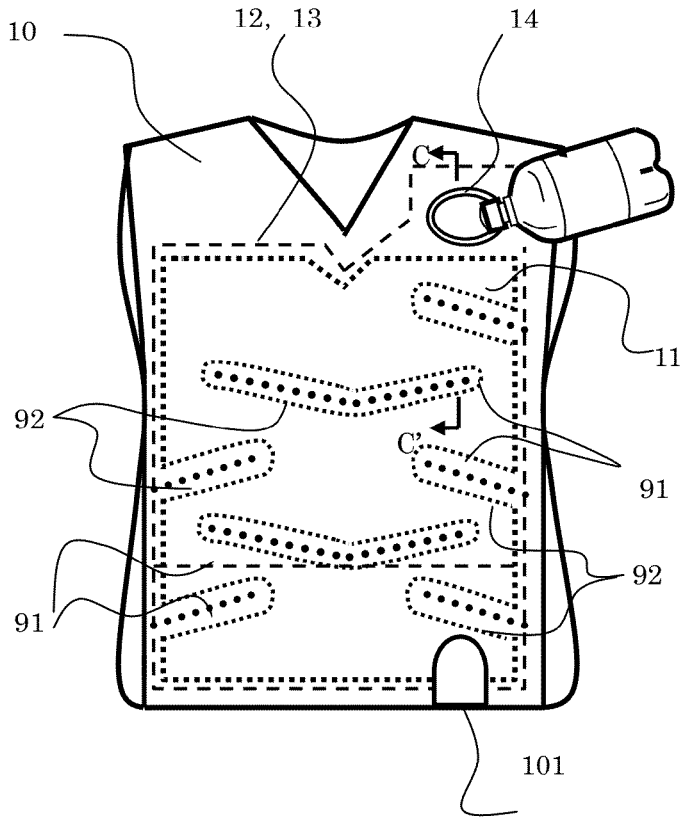
FIG. 9 is a diagram showing a configuration example of another water partition cooling garment of the present invention.

FIG. 9 is a diagram showing a configuration example of another partition water cooling garment of the present invention.

Figure 10:
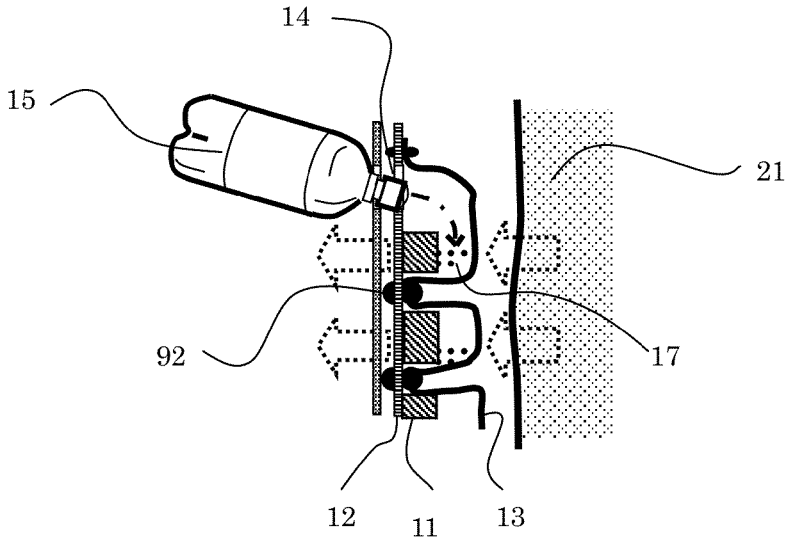
FIG. 10 is a diagram showing the C-C' cross section shown in FIG. 9.

FIG. 10 is a view showing a C-C' cross section.

Water absorbing material 11 of the surface shape in the present embodiment is configured such that cutouts 91 in the vicinity of the partition of the water. Partitioning of water on volunteers were pre-described described in FIG. 1, a suitable tilt angle, performing a water discharge by overflow the reservoir of water, a high-frequency and intermediate pad 12 and seat or tarpaulin 13 as shown in FIGS. 9 and 10. It can also be configured as a sealing joint water portion 92 by a chemical adhesive or thermal bonding. Place in FIG. 10 and FIG. 9, the water partition by the seal coupling part due to the high frequency heat bonding is in cutout partial 91 surface of water absorbing material 11. At this time, as described earlier, both the sheet or tarpaulins 13 and intermediate pad 12 if a so-called waterproof breathable fabric, such as a main component such as polytetrafluoroethylene of fluorine resin, the high-frequency thermal bonding It can be and can configure the sealing coupling water portion 92 easily, etc., is obtained in the processing method of the low-cost cooling garment having the cooling effect of evaporation heat.

Next, I will explain an example of an embodiment of a cooling cover to cool the head of the present invention.

Figure 12:
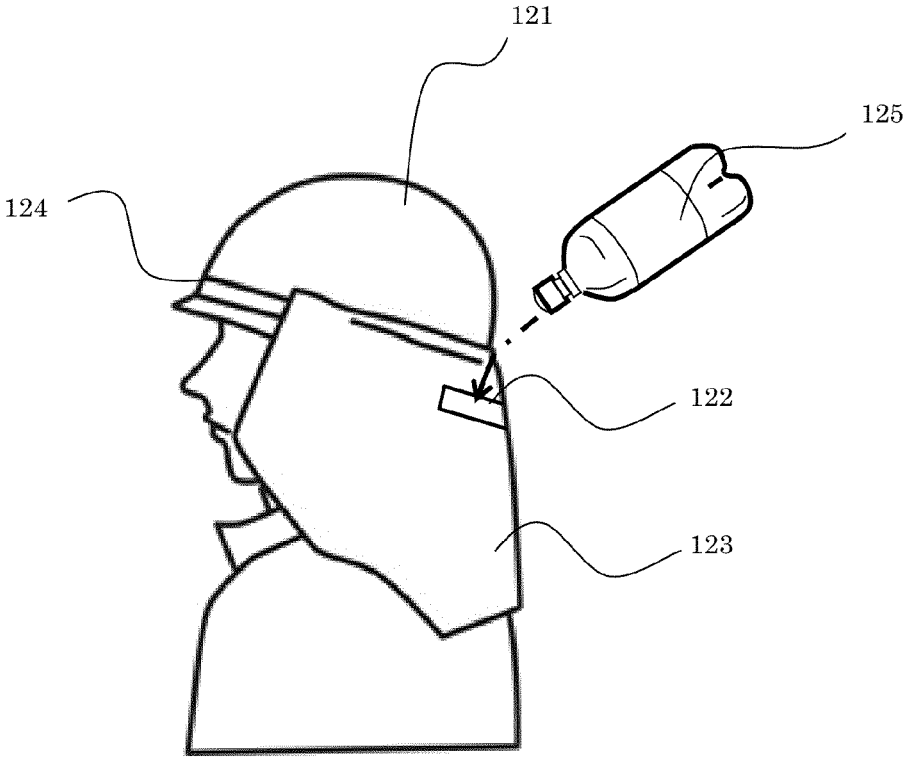
FIG. 12 is a diagram showing a use state of the cooling cover to cool the head of the present invention.

FIG. 12 is a view showing a use state of the cooling shroud to cool the head of the present invention.

The head cooling cover (hereinafter, referred to as a cooling cover) are attached hat for protect the head, or helmet 121 by front band 124.

Water supply port 122 is provided at the cooling shroud.

Figure 13:
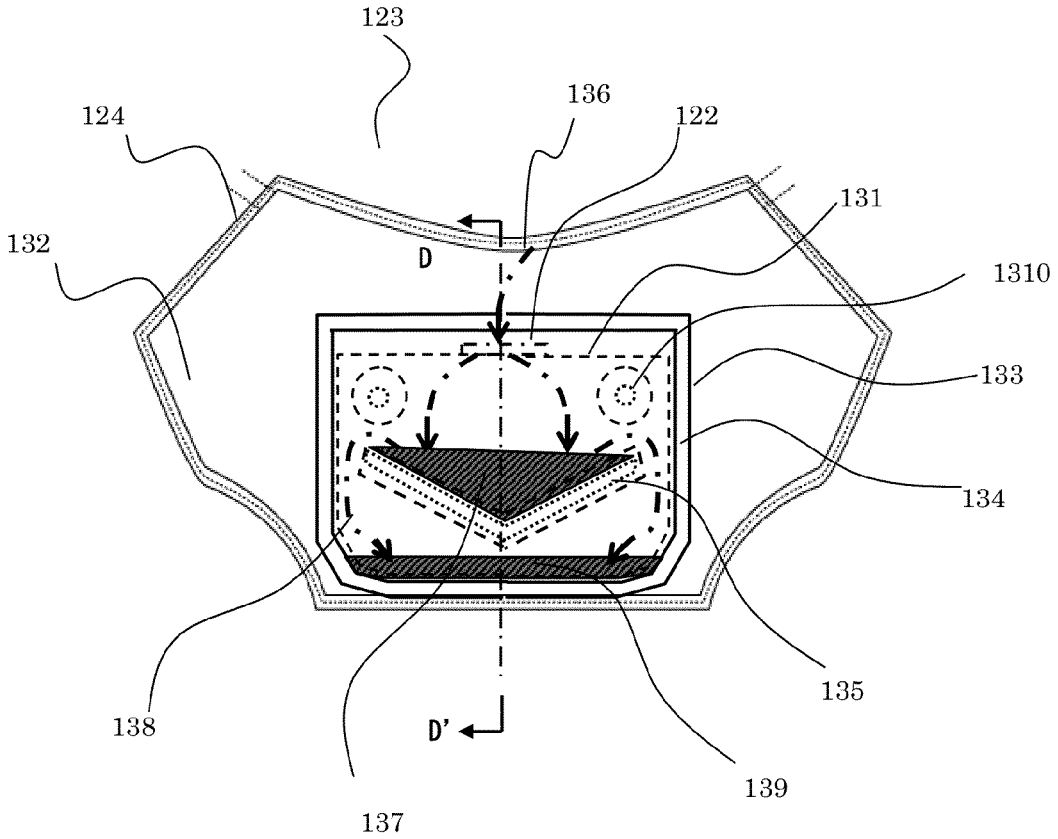
FIG. 13, Figure shows the structure of a cooling cover of the present invention

125 is a plastic bottle you are going to put the water in the interior of the cooling cover wearable implement 123 from the filling FIG. 13 is a view a view showing a structure of a cooling cover of the present invention, as viewed from inside the cooling cover wearable implement 123.

There is the outer cover 132 of the outer material and the waterproof breathable with an area of enough to hide the cheek, the cover section 133 of the inner and the waterproof breathable material compress as well.

Then, (in the sandwich) across the water absorbing material 131 planar enough to cover the back of the head or heads, so as create an enclosed space, and a heat fusion bonded seal 134 on four sides around the inner cover portion.

In addition, in places, cutting out the water absorption material, and held in a vertical direction water-absorbing material, and, for the formation, to provide a point of joining 1310 processing the inner cover portion and the outer cover portion waterways.

In the top of the outer cover 132, water supply port 122 is provided at a position where it can irrigation water to the sealed space.

At this time, at a position resolution of an intermediate position enough longitudinal direction of the water absorbing member 131 (the vertical direction), the water to have a length in the horizontal direction were taken from the water supply port 122 to as accumulated adaptation.

And to provide a water partitioning adhesive seal portion 135 for being heat-sealed bond V-shape, the inner cover portion 133 and the outer cover 132, to create a water reservoir water overflow to flow down.

At this time, it is water absorbing material 131 of the seal portion and keep hollowed out. Accordingly, the water 136 from the water supply water supply port 122 may puddle 137 water partitioning adhesive seal portion 135 for making the water reservoir.

138 water which overflowed to create a water reservoir 139 of another beneath.

Depending on the material density of the water-absorbing material 131, but the height limit increase of moisture by capillary action of the water-absorbing material which is available at low cost in general is a 7 cm 8 cm from the vertical direction.

For example, when the height of the longitudinal direction of the water absorbing material 131 of the cooling cover of the present invention (the vertical direction) was set to around 15 cm, to provide the water partitioning adhesive seal portion 135 for making a puddle on the dividing position in between about herf.

It is possible to use of a capillary phenomenon, uniform, and to supply water for a long time over the entire area of about 8 cm, for example the height of the upper direction from the water partitioning adhesive seal portion 135 of the 131 water absorbing material.

Further, the entire area of about 7 cm such height downward capillary phenomenon of the water absorbing material 131 from the water reservoir part 139 of another lower, water is supplied uniformly more.

Thus, the entire surface area of the 15 cm in height of the water absorbing member 131, uniform, and through the outer cover 132, to vaporize the water.

Head side in contact with the inner cover portion 133 with the heat of vaporization can be obtained a cooling effect for a long time.

Figure 14:
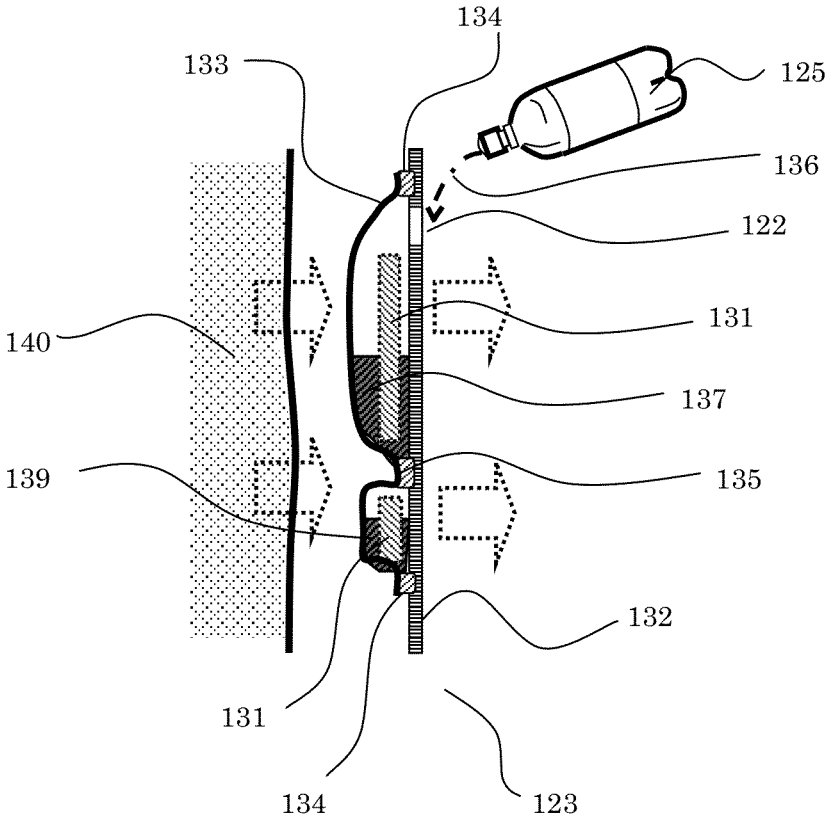
FIG. 14 is a diagram showing the D-D' section shown in FIG. 13.

FIG. 14 is a diagram showing the D-D' section shown in FIG. 13.

Sign in FIG. 13 and FIG. 14 shows the same thing.

Water absorbing material 131 is in the vertical plane, the water retention is vertically uniform.

Humidity-permeable portion of the inner cover 133 and outer cover 132, made of a waterproof breathable, the vaporized water is heat of vaporization cooling.

Thus, a back of the head side 140 is radiated to the outside through the cooling cover wearable implement 123.

According to experiments, if the moisture permeation amount was used to both outer cover 132, and inner cover 133, using a waterproof breathable performance of about 13,500 g/m2/24 hr, ambient temperature at 33° C. to 38° C. environment, from water supply port 122 for example 10° C., if you turn on the cold water of 130 ml, vaporization amount was about a 17 ml per hour.

The contact temperature of the inner cover part was able to get the heat of vaporization cooling effect of about 6 hours at 20° C. to 28° C.

In the configuration in general, is sandwiched between cloth through the normal water a water absorbing material, is immersed in water, to use squeeze light, which is cooled duration of about 2 times the same cooling cover with a heat of vaporization cooling was effective to obtain.

Figure 15:
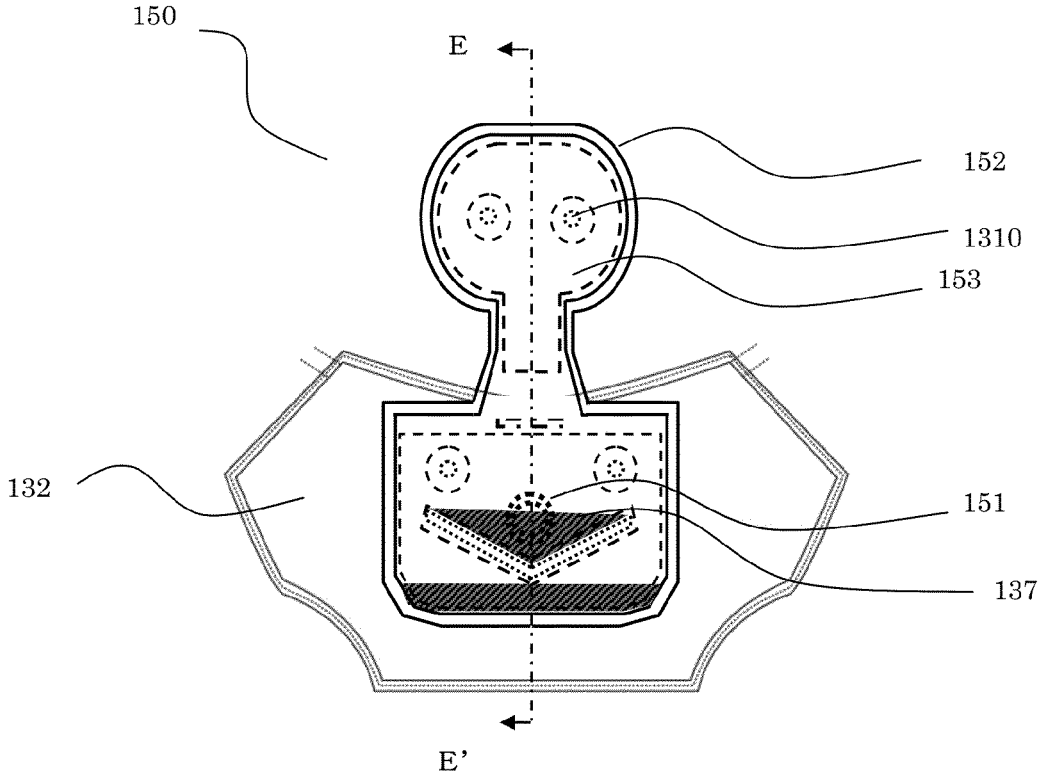
FIG. 15 shows the cooling cover wearable implement with extended top part of head, it is including a water absorbing material.
Figure 16:
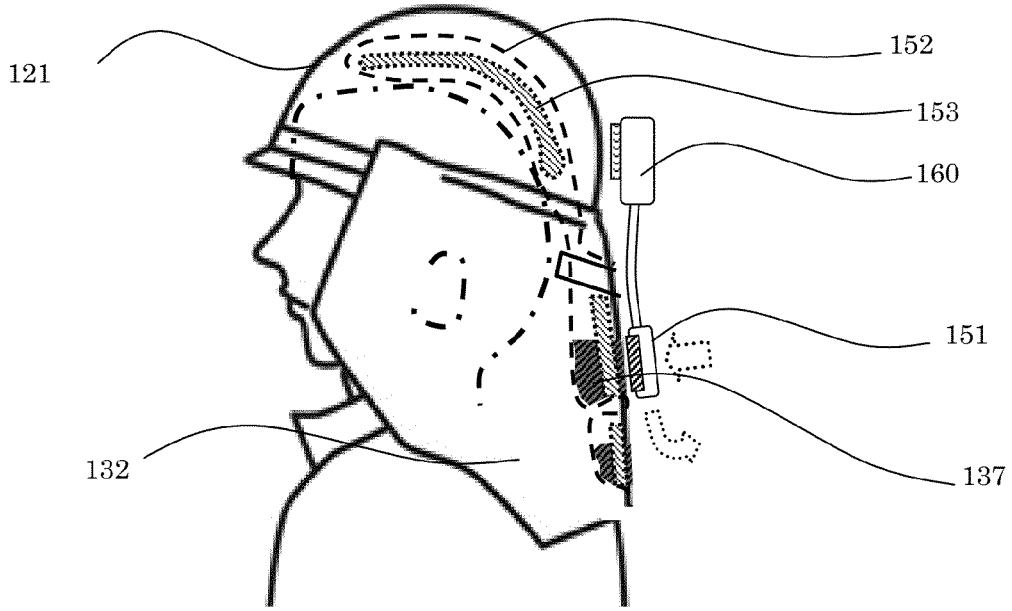
FIG. 16 shows a cross section E-E' of the cooling cover wearable implement of FIG. 15, and it was attached to the human with a helmet.

In addition, FIG. 15 is a view of the cooling shroud attachment which extends to the top of the head to be integrated cooling unit including a water absorbing material. Shows a cross section E-E' of the cooling cover mounting device of FIG. 15, FIG. 16 is a drawing showing that that attached to a person wearing the helmet.

Figure 17A:
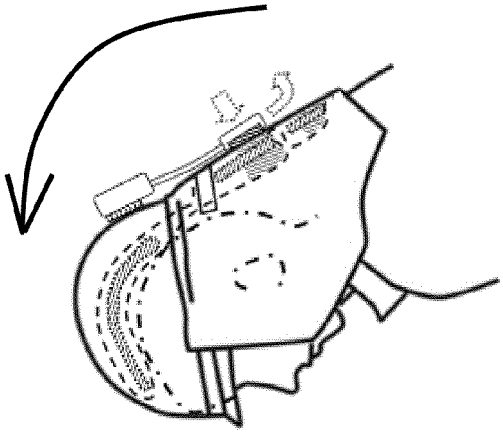
FIGS. 17A and 17B are a diagram showing a use state of the cooling cover wearable implement is attachment.
Figure 17B:
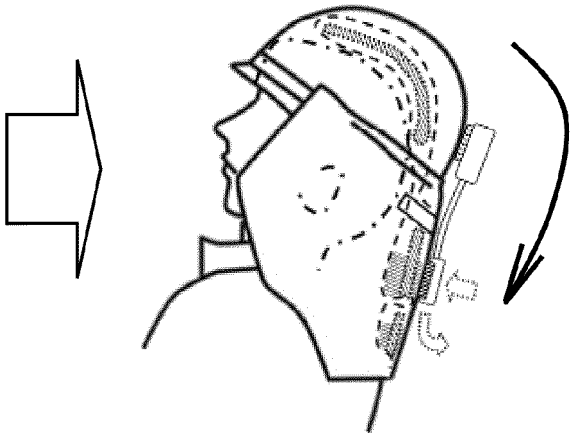

FIGS. 17A and 17B are views showing a use state of the cooling cover attachment.

To be in contact with the water or near the water of the water reservoir 137 is provided with a cooling source 151 of refrigerant ,or such as cooling elements of electronic cooler by the Peltier effect. In this case, it is same effective, if using ice which put in the puddle of the cooling cover Outdoor work during the summer, I can be cooled to around 10° C., the ambient atmosphere for example became a high temperature to 30° C., such as water in the water reservoir 137.

Therefore, the state shown in FIG. 17B from FIG. 17A, the use state of the mounting the cooling cover wearable implement extending head top 150.

For example, the water absorbing material 153 in the integral cooling extension 152 to the top of the head up, the temporary head about water of 137 the water reservoir to flow back by gravity cooling cover wearable implement 150 was extended parietal up to be integrated cooling unit I lowered basis.

And also, then, I will do attitude behavior of returning.

Water in the water reservoir 137, which is the cooling penetrates chilled water-absorbing material 153 of the top of the head as well and the water absorbing material 137 of the top cover.

Then, the mix with water in the water pool of the other not in contact with the cooler, and returns to the water reservoir 137 to the water warmed is provided with the cooling element.

Repeating each hour for about 30 minutes, this behavior can always be evenly distributed to the cooling cover wearable implement extending head top 150 overall, the water is cooled by the cooling source 151. In the figure, 160 indicates a power supply unit which is mounted on the helmet for driving the cooling source 151 of the thermoelectric cooler and the like by the Peltier effect.

This has the effect that it does not require a pump or requiring a new driving force for circulating the upper and lower cooling water, a pipe mechanism prone to clogging, it is possible to realize the uniform at low cost.

Similarly, also the cooling garment of the present invention, somewhere in the water reservoir of FIG. 1, a position, or easy to be the lowest accumulated water, instead of the small electric fan 71, for example, shown in FIG. 7, the cooling device by providing a cooling source 151 of the refrigerant, and the like, while the wear, and the operation of lean forward from time to time, the cooling garment, to raise or lower back flow the water in the water reservoir of the cooling garment within the overall, based on the attitude By returning the same manner as described above, it is possible to uniformly, it is possible to allocate the cooling water in the cooling garment whole, to obtain a large cooling effect further heat of vaporization of water cold.

Although not shown in the figure, when using the refrigerant as a cooling source 151 in the above, the cooling garment 10 and the outer cover 132, it is preferable to provide a pocket which can hold it.

Description in the figure is omitted, cooling cover of the present invention is changing the shape is not only available in high-temperature environment or under the scorching sun of the head of the people, and so as to cover in the body and head of horses, such as dogs, It is one that can also be used to heat measures of the summer, it is cooling attachment.

In particular, compared to the cooling cover of the structure is sandwiched between cloth through a normal water water-absorbing material of said, there is no feeling that I wet the back side which is in contact with the skin, do not wet with water.

People as well, there is an advantage in effect the animal, dog, horse, etc. does not dislike wearing.

Similarly, the surface is not exposed to water, electrical insulating properties also relatively good. So there is also an effect that is said to be easy to use for electrical work. In the description of the figure, in the description of the embodiments of the cooling cover wearable implement 123 and the embodiment in cooling garment 10 of the present invention, respectively, In here, the same role material is named same, like the water absorbing material 131 is same name the water absorbing material 11, and the puddle 137 is same name the puddle 17 etc.

Are each the same invention, it is intended to simplify the explanation in the each example was given different numbers in accordance with the drawing number.

Recently, the warming of the earth every year is in progress, much less exhaust heat of air conditioning in the building or the like is released to the outside, so-called heat island current situation is occurring in urban areas.

Under such circumstances, in particular, outdoors in urban areas, civil engineering under the hot weather of summer, construction work, the equipment maintenance, etc., attention to heat stroke of the worker has been advocated strongly, occupational health safety and it has evolved into a big problem on.

Until now, the invention for cooling the neck portion or head, of the body was present. However, the present invention of a low cost and, allows the replacement of water in order to continue the cooling effect of evaporation heat, the entire upper body, it is possible to detect the proper amount of replenishment water.

In addition, the small blower, efficient, low-cost, I can provide a cooling garment for the upper body full broadly, to promote the vaporization, has further enhanced the cooling effect.

But is to be contribution measures the heat of the, the resolution of occupational health safety over the heat stroke measures, industrial applicability is very large.

Further, the cooling cover the same invention, in the configuration in general, is sandwiched between cloth through the normal water a water absorbing material, is immersed in water, to use and squeeze gently, and a similar cooling cover with a heat of vaporization cooling I obtained a cooling duration of about 2-fold. In addition, as described above, so also serves as a cooling wearable implement that can be used as a pet such as a dog, even heat stroke measures of domestic animals such as horses, and are of great industrial applicability.

What is claimed is:

1. A wearable implement comprising;

a water absorbing material having a planar shape; and a waterproof breathable sheet or cloth having both functions of waterproof and breathable, wherein the water absorbing material is wrapped by the waterproof breathable sheet or cloth at one side or both sides, a gap is formed between the water absorbing material and the waterproof breathable sheet or cloth, a water inlet is provided so that water is filled in the gap from an outside, a waterway is configured by a sewing or an adhesion joint processing of the waterproof breathable sheet or cloth, which wraps the water absorbin material, so that the water flows vertically and horizontally on an entire surface of the water absorbing material, and the water filled from the water inlet is dispersed over the entire surface of the water absorbing material and penetrated into the water absorbing material so as to obtain a cooling effect of heat of vaporization.

2. The wearable implement according to claim 1, wherein a portion configured by the sewing or the adhesion joint processing has a width like a character of V in a horizontal direction, a partition is provided to form a puddle and configure the waterway in a stepped shape downwardly from a top, moisture is replenished widely to an upper side of left and right of the entire surface by the water of the puddle and capillary action of the water absorbing material so as to obtain the cooling effect of heat of vaporization.

3. The wearable implement according to claim 2, wherein when a plurality of partitions are provided, an interval between the partition is within a range that the moisurure can be raised by the capillary action of the water absorbing material.

4. The wearable implement according to claim 2, wherein an inlet is provided for blowing air from a small fan, the waterway configured in the stepped shape is also used as an air passage, the water inlet is also used as an outlet of the air, and after the water is penetrated into the water absorbing material, the vaporization is promoted at the surface of the water absorbing material by blowing the air from the small fan.

5. The wearable implement according to claim 2, wherein a cooling source of a refrigerant, an ice or a Peltier effect thermoelectric cooling element is provided so as to be in contact with the water filled or the water of the puddle.

6. The wearable implement according to claim 1, wherein a sensing location, which is a hollow of the water absorption material, is provided at a lower end of the water absorption material so as to detect that the water inserted from the water inlet reaches the lower end by a human finger.

* * * * *